US010526560B1

(12) United States Patent
Clarke et al.

(10) Patent No.: US 10,526,560 B1
(45) Date of Patent: Jan. 7, 2020

(54) PROTECTIVE LUBRICANT FORMULATION AND METHOD OF USE

(71) Applicants: Benjamin Clarke, Lompoc, CA (US); Paul Bessette, Dartmouth, MA (US)

(72) Inventors: Benjamin Clarke, Lompoc, CA (US); Paul Bessette, Dartmouth, MA (US)

( * ) Notice: Subject to any disclaimer, the term of this patent is extended or adjusted under 35 U.S.C. 154(b) by 0 days.

(21) Appl. No.: 16/160,779

(22) Filed: Oct. 15, 2018

(51) Int. Cl.
*C10M 147/04* (2006.01)
*C10M 105/52* (2006.01)
*C10M 169/04* (2006.01)

(52) U.S. Cl.
CPC ..... *C10M 147/04* (2013.01); *C10M 105/52* (2013.01); *C10M 169/041* (2013.01); *C10M 2211/0206* (2013.01); *C10M 2213/06* (2013.01); *C10N 2230/12* (2013.01)

(58) Field of Classification Search
CPC ..... C10M 147/04; C10M 105/52; C10M 169/041; C10M 2211/0209; C10M 2213/06; C10N 2230/12
See application file for complete search history.

(56) References Cited

U.S. PATENT DOCUMENTS 4,472,290 A * 9/1984 Caporiccio ..... C10M 169/00 508/181
8,067,344 B2 * 11/2011 Shimura ..... C10M 105/54 508/181
9,309,479 B2 4/2016 Schweigkofler et al.
2012/0157363 A1 * 6/2012 Knapp ..... C09K 3/30 508/582

OTHER PUBLICATIONS

Kalathil C. Eapena, Steven T. Pattona and Jeffrey S. Zabinskib, Lubrication of microelectromechanical systems (MEMS) using bound and mobile phases of Fomblin Zdol®, Jan. 2002, 2 pages, vol. 12, Dayton, OH 45469-0168, USA.

* cited by examiner

*Primary Examiner* — Cephia D Toomer
(74) *Attorney, Agent, or Firm* — Fulwider Patton LLP

(57) ABSTRACT

A novel method of preparing metal assemblies for long term storage and instant readiness for use, utilizing a light oil mixture or grease mixture incorporating functionalized and molecularly neutral PFPE fluid and a fluorosolvent.

4 Claims, No Drawings

PROTECTIVE LUBRICANT FORMULATION AND METHOD OF USE

BACKGROUND OF THE INVENTION

This invention relates to the formulation and use of protective storage coatings that are also operational lubricants. The inventive formulations, when used according to the inventive method, serve a double role as an anti-corrosion coating and a high-performance lubricant, eliminating the necessity of removing anti-corrosion coatings from stored assemblies and replacing them with lubricants.

Many machine parts and assemblies such as farm and factory equipment, commercial fishing gear, firearms, space launch equipment, and military hardware are regularly stored awaiting seasonal or sudden requirements for use.

Prior art and conventional methods dictate that machine parts and assemblies be coated or packed in an anti-corrosion material prior to storage. The anti-corrosion material is formulated for low mobility so that it will not flow away from coated areas and expose those surfaces to air, water, or corrosive materials transferred during handling. When taken out of storage, the corrosion inhibiting material is typically cleaned off and replaced by an operational lubricant.

Conventional lubricants, unlike conventional anti-corrosion coatings, must have mobility to perform well. Mobility is defined herein to encompass characteristics of a fluid that promote movement away from an element of surface that it initially covers. A fluid will exhibit mobility under the influence of extrinsic influences such as gravity, thermal or pressure gradients, and van der Waals forces, and by intrinsic properties such as viscosity, surface tension, and pour point. During use, a thin layer of lubricant may provide a low friction interface between two metal surfaces due to its intrinsic mobility, causing some of the lubricant to be displaced. The displaced lubricant is generally replaced by excess lubricant adjacent to the area of displacement, otherwise the contact area may become "dry"—have no lubricating layer—after continued use. An anti-corrosion coating must stay in place under normal extrinsic influences such as those listed, and lacks the intrinsic mobility to be a suitable lubricant. Thus, conventional lubricants are mobile fluids, and conventional anti-corrosion coatings are not.

In the prior art, proper storage of metal assemblies requires cleaning, then coating or packing metal parts and assemblies with an anti-corrosion coating. Typical anti-corrosion materials comprise homogeneous mixtures of oily and waxy long-chain, non-polar hydrocarbons. Examples of generic and popular anti-corrosion material include formulations such as that marketed by Houghton Technical Corp. under the trademark Cosmoline®. These formulations all contain hazardous volatile components and require personal protective equipment to be used during application. None of these corrosion inhibitors have the proper mobility, lubricity, or viscosity to act as an operational lubricant, and so must be removed when the parts and assemblies are taken out of storage, requiring the use of solvents that are also hazardous.

Likewise, typical lubricants used in the operation of machine parts and assemblies are poorly suited as long-term corrosion inhibitors. Historically, lubricants have been chosen for their mobility and viscosity, two characteristics that enable migration of the lubricant over time, exposing surfaces that require protection from corrosion. Re-application of lubricant is the accepted method of dealing with this on machine parts and assemblies in use, but in long-term storage it is undesirable and may be completely impractical to re-apply lubricant periodically. Thus, long-term storage provides migration time adequate to expose surfaces to corrosive action by humid air, salt air, industrial fumes, etc. For purposes of clarity, long-term will be defined herein as periods longer than one month, and up to several decades in extent. Short-term storage will be defined herein as periods shorter than one month.

In the hard disc drive and microelectromechanical systems (MEMS) technology industries, lubricant is applied once during manufacturing and there is no later opportunity to re-apply during use. Lubricant development for these applications has had to overcome lubricant migration issues that lead to excessive early wear, though corrosion protection is a low priority. The resulting developments are however applicable to corrosion prevention, since they prevent lubricant migration. Most notably, dual-layer lubricant structures have been developed that comprise a bonded first lubricant layer and a mobile second lubricant layer. Exemplary methods are described in the work of K. C. Eapen et al. in "Lubrication of microelectromechanical systems (MEMS) using bound and mobile phases of Fomblin® Zdol" [Tribology Letters, Vol. 12, No. 1, January 2002]. In this work, a first layer of lubricant is applied and treated to cause bonding with a silicon surface. Unbonded lubricant is rinsed off with a suitable solvent, and a second layer is then applied, creating bonded and mobile layers of lubricant, resulting in a 20-30× improvement in wear lifetime compared to the use of a single mobile layer.

Fomblin® Zdol is a "bifunctional" perfluoropolyalkether (PFPAE) molecule with terminal $CH_2OH$ "alcohol" groups at each end, so the ends will form covalent bonds with Si—OH groups on a silicon surface.

Higher density base layers can be formed on a surface if the molecules have "polarity", meaning that only one end of the molecule terminates in a functional alcohol, acid, or metal salt group. Polar molecules will align and contact a surface under the influence of van der Waals forces, reducing the surface energy. Covalent bonds between the molecules and the surface may form over time or under the influence of activation processes such as heat. UV exposure, or other methods.

Perfluoropolyether (hereinafter referred to as PFPE) is a liquid lubricant used extensively in the semiconductor, hard disc drive, and MEMS industries. PFPE is an "extreme lubricant"; a light oil with lubricity, viscosity, operating temperature range, and compatibility with other materials that exceeds those of conventional lubricants. The PFPE molecule may be functionalized in ways that cause one end of the molecule to be preferentially attracted to a surface, such as metal. Thus, the functionalized PFPE molecules may provide a low-mobility bonded layer between a metal surface and a mobile layer of molecularly neutral (unpolarized) PFPE fluid. For clarity, any reference to functionalized PFPE hereinafter is to be interpreted this way.

In U.S. Pat. No. 9,309,479, Schweigkofler et al. teach the use fumed silica particle additives to a PFPE formulation for anti-squeak applications on surfaces such as upholstery, plastic hinges, and roller bearings. The formulations include a functionalized PFPE additive, the fused silica particles thus employed provide a large surface area to attach the functionalized PFPE and reduce the mobility and migration characteristics of the formulation. This makes the formulation suitable as an anti-squeak treatment that is less readily absorbed by upholstery materials and plastic surfaces.

What is needed, and provided by the inventive formulations and methods disclosed here, is a high-performance lubricant that also provides suitable long-term anti-corrosion performance during storage.

Accordingly, several objects and advantages of the present invention are:

to provide a corrosion inhibiting coating that is also an operational lubricant;

to provide a first formulation of said material in the form of a light oil;

to provide a second formulation of said material in the form of a grease;

to provide a method for using said material that is consistent with the needs of a broad range of machines, machine parts, and assemblies so that they may be stored for long periods, i.e., months or years, in a state of readiness with only the light oil and grease formulations of said material applied as a protective anti-corrosion treatment, and may be subsequently removed from storage and used immediately without the need for excessive cleaning, exposure to toxic solvents, or applying any other lubricating material.

A further object is to provide the said material in oil and grease formulations specifically engineered for the operation and protective storage of military equipment, including but not limited to vehicles, large and small firearms, and other equipment that can be described broadly as metal assemblies. For instance, a cache of military equipment may be stored in a protected state and made ready for use without requiring the removal of hardened waxy residues and subsequent re-lubrication with operational lubricating oils and greases.

A further object is to provide both formulations of said material in a form that is non-flammable, easy and economical to apply, relatively odorless, and biologically non-toxic.

A further object is to provide both formulations of said material in a form that has an operational temperature range of at least −60 to 608 degrees Fahrenheit.

SUMMARY OF THE INVENTION

The present disclosure describes a neutral PFPE fluid blended with a corrosion inhibitor in the form of a functionalized PFPE. Functionalized PFPE molecules have been modified to exhibit polarity through the formation of, for instance, acid or alcohol end groups.

The functionalized PFPE component of the inventive formulation is selected for its attraction to metal surfaces, on which said metal surfaces it forms a continuous or near-continuous self-assembled monolayer of PFPE molecules. The layer thus formed blocks corrosive material from penetrating to the metal surface. Corrosive materials that do not break down or otherwise degrade PFPE include water, salt air, salt water, finger oils, fuming sulfuric acid, chlorine gas, oxygen, solvents, and many others.

The inventive formulation may be extended in a non-flammable evaporable fluorinated solvent or "fluorosolvent" to achieve a desired viscosity. The addition of fluorosolvent thins the PFPE blend, allowing it to be applied in various ways, including by dipping, brushing, spraying, or wiping on. The fluorinated solvent provides easy diffusion of the functionalized PFPE component to the metal surfaces. Upon evaporation of the fluorosolvent, a base layer of functionalized PFPE remains, supporting a mobile layer of unfunctionalized PFPE.

The blend may also be thickened into a high-performance grease by the addition of polytetrafluoroethylene (PTFE) particles, without impact to operating temperature range. Under ASTM D 2596, the "Standard Test Method for Measurement of Extreme Pressure Properties of Lubricating Grease (Four Ball Method)", the inventive grease formulation did not fail under maximum test loading of 800 kilograms.

The blend is serviceable beyond a range extending from −51 to 320 degrees Celsius (−60 to 608 degrees Fahrenheit), and when blended in the inventive formulations disclosed here, is especially advantageous for use as a firearm operational lubricant that doubles as a protective anti-corrosion treatment for long term storage. The inventive formulation eliminates the need for conventional pre-storage anti-corrosion treatments, such as Cosmoline, and the time and labor previously dedicated to the subsequent and necessary removal of said treatment and re-application of operational lubricants.

Traditional lubricants used on firearms ("gun oils") are typically serviceable from −44 to 241 degrees Celsius, (−48 to 465 degrees Fahrenheit). Traditional gun oils are composed of hydrocarbons that degrade and generate gum and tar residues when exposed to heat, such as the heat generated during extended rapid firing. When traditional gun oil has been degraded by heat, as under heavy use, the degraded oil loses its lubricating properties and the gum and tar residues are difficult to remove.

Furthermore, traditional hydrocarbon gun oils contain flammable components that are odoriferous and biologically toxic. The inventive PFPE lubricant formulation is composed of non-flammable ingredients that are odorless, non-toxic, do not produce gum or tar residues at elevated temperatures, can be applied easily, and remain serviceable over a wide temperature range.

DETAILED DESCRIPTION OF THE PREFERRED EMBODIMENTS

The preferred embodiments include light oils and greases comprising a PFPE fluid blended with a functionalized or polarized PFPE as corrosion inhibitor, said blend extended in a non-flammable fluorosolvent. Both neutral and functionalized PFPE is commercially available, for example under the trade names KRYTOX, FOMBLIN, GALDEN, and DEMNUM. A common characteristic of the PFPE fluids is the presence of perfluoroalkyl terminal groups.

Fluorosolvent is widely available commercially under various trade names, including VERTREL and NYE FLUOROSOLVENT 504. A preferred embodiment is a fully fluorinated solvent consisting of a chain length of C5 to C18 carbon atoms. Less than C5 and the solvent would be too volatile and higher than C18 and it would be to non-volatile. A preferred solvent is Tribosyn 84113, marketed by Tribo-science & Engineering, Inc.

In one preferred embodiment, a light oil is made by blending (by weight) one part of a functionalized PFPE fluid with nine parts of a neutral PFPE fluid, and extending the blend in ninety parts of a non-flammable fluorosolvent. The functionalized PFPE fluid is selected from a viscosity range of 15 to 500 cSt at 40° C.

In a second preferred embodiment, a grease is made by blending (by weight) one part of a functionalized PFPE fluid with nine parts of a neutral PFPE fluid, and thickening the blend by adding one to seven parts of polytetrafluoroethylene (PTFE) particles, having a primary particle size of less than 20 micros, said particles averaging five microns in size. In a preferred embodiment four to five parts of PTFE are added.

In operation, the inventive formulations provide protection against oxidation and corrosion from exposure to water, salt air, salt water, finger oils, fuming sulfuric acid, chlorine gas, oxygen, solvents, and industrial chemicals that do not react with PFPE molecular structures, which said structures are uniquely non-reactive to many common chemicals. Additionally, the inventive formulations provide lubrication to prevent galling, sticking, jamming, and excessive wear during hard use, as for instance in the extended high-volume use of factory machinery and firearms.

In its preferred embodiment, the inventive formulation may be applied to a firearm prior to storage in, for instance, an environment without humidity control, or in a salt air environment, such as on a naval vessel. Said firearm is thereby maintained in a state of instant readiness.

While the above description contains several embodiments, these should not be construed as limitations on the scope of the invention, but as exemplifications of the presently preferred embodiments thereof. Many other ramifications and variations are possible within the teachings of the invention.

Thus, the scope of the invention should be determined by the appended claims and their legal equivalents, and not by the examples given.

We claim:

1. A method of lubricating and preparing metal assemblies for long-term storage and protection from corrosion by applying a light oil mixture on their surfaces that is comprised of PFPE fluid that has been molecularly functionalized such that its component molecules are attracted to metal surfaces, PFPE fluid that is molecularly neutral, and an evaporable fluorosolvent.

2. The method of claim 1 in which the metal assemblies are firearms and firearm components and the light oil mixture is comprised of one part, by weight, of PFPE fluid that has been molecularly functionalized such that its component molecules are attracted to metal surfaces, eight to ten parts by weight of PFPE fluid that is molecularly neutral, and sixty to one hundred parts, by weight, of an evaporable fluorosolvent.

3. A method of lubricating and preparing metal assemblies for long-term storage and protection from corrosion by applying a grease on their surfaces that is comprised of PFPE fluid that has been functionalized such that its component molecules are attracted to metal surfaces, PTFE particles, and PFPE fluid that is molecularly neutral.

4. The method of claim 3 in which the metal assemblies are firearms and firearm components and the grease is comprised of one part by weight of PFPE fluid that has been functionalized such that its component molecules are attracted to metal surfaces, one to seven parts, by weight, of PTFE particles, said particles averaging two to twenty micro-meters in size, and seven to ten parts by weight of PFPE fluid that is molecularly neutral.

* * * * *